United States Patent [19]

Sugiura

[11] 4,245,610

[45] Jan. 20, 1981

[54] IGNITION APPARATUS FOR INTERNAL COMBUSTION ENGINE

[75] Inventor: Noboru Sugiura, Katsuta, Japan

[73] Assignee: Hitachi, Ltd., Japan

[21] Appl. No.: 909,069

[22] Filed: May 24, 1978

[30] Foreign Application Priority Data

May 25, 1977 [JP] Japan ..... 52-59798

[51] Int. Cl.[3] ..... F02P 3/04

[52] U.S. Cl. ..... 123/609; 123/644

[58] Field of Search ..... 123/148 E; 315/209 T

[56] References Cited

U.S. PATENT DOCUMENTS

| | | | |
|---|---|---|---|
| 3,605,713 | 9/1971 | Lemasters et al. | 123/148 E |
| 3,838,672 | 10/1974 | Richards et al. | 123/148 E |
| 3,892,219 | 7/1975 | Preiser et al. | 123/148 E |
| 3,902,471 | 9/1975 | Brungsberg | 123/148 E |
| 3,937,193 | 2/1976 | Kim | 123/148 E |
| 4,008,698 | 2/1977 | Gartner | 123/148 E |
| 4,030,468 | 6/1977 | Sugiura et al. | 123/148 E |

FOREIGN PATENT DOCUMENTS

| | | | |
|---|---|---|---|
| 52-1340 | 1/1977 | Japan | 123/148 E |
| 52-3943 | 1/1977 | Japan | 123/148 E |

*Primary Examiner*—Tony M. Argenbright

*Attorney, Agent, or Firm*—Craig and Antonelli

[57] ABSTRACT

An ignition apparatus for an internal combustion engine is disclosed in which a current control circuit for so limiting the collector current of a power transistor for controlling the primary current of an ignition coil that the collector current may not exceed a predetermined value, is provided. The current control circuit comprises a circuit for generating a preset reference voltage and a comparison circuit for comparing the reference voltage with a voltage proportional to the collector current of the power transistor, and controls the conductivity of the drive transistor for controlling the drive current for the power transistor in accordance with the output signal of the comparison circuit. The current control circuit is provided with a small resistance between ground and the junction point of the emitter of the drive transistor and the negative terminal of the reference voltage generating circuit, whereby a feedback circuit including the reference voltage generating circuit and the comparison circuit is provided for the emitter-collector path of the drive transistor.

7 Claims, 4 Drawing Figures

IGNITION APPARATUS FOR INTERNAL COMBUSTION ENGINE

LIST OF PRIOR ART REFERENCE (37 CFR 1.56 (a))

The following reference is cited to show the state of the art:

U.S. Pat. No. 3,838,672; Roy C. Richards et al., Oct. 1, 1974, 123/148E.

BACKGROUND OF THE INVENTION

This invention relates to an ignition apparatus and more particularly to an ignition apparatus provided with a control circuit for preventing a small oscillation caused at the time when a current is limited.

Usually, an ignition apparatus for an internal combustion engine is provided with a current control circuit for preventing more current than a predetermined level from flowing through a power transistor which is connected in series with the primary winding of an ignition coil to control flow of the primary current of the ignition coil. In such a control circuit a small oscillation is generated at the time the collector current of the power transistor is limited because of a high gain of the control circuit and delay in the operational response of the power transistor. This small oscillation in turn causes the base current, the collector-emitter voltage and the collector current of the power transistor to oscillate. As a result, stability in operation of the power transistor is degraded and the collector loss is increased so that heat generated may destroy the power transistor. For this reason, the oscillation, at the time the collector current is limited should be prevented.

In the prior art measures for preventing such an oscillation, either the gain of the entire current control circuit is limited to a small value, or a capacitor is inserted in the feedback loop of the current control circuit so as to utilize delay in signal phase, as disclosed by the U.S. Pat. No. 3,838,672.

In the case where a part of the current control circuit is constructed in a monolithic IC configuration, however, the current amplification factors of transistors contained in the monolithic IC have different values within a range of 30 to 200 and there is only a little probability that a monolithic IC containing transistors all having small current amplification factors will be obtained. Accordingly, the productivity of monolithic IC's with which the gain of the entire current control circuit can be made small, is limited, so that the yield rate of ignition apparatus is lowered and the production cost is raised. When a part of the current control circuit is constructed with a monolithic IC, therefore, the method using a capacitor is employed for preventing the oscillation. According to this method, however, the use of a capacitor will raise the cost of the apparatus and also increase the size of the apparatus.

SUMMARY OF THE INVENTION

The object of this invention is to provide an ignition apparatus in which a part of the current control circuit is constructed with a monolithic IC and which can prevent the oscillation caused at the time when the current through the power transistor is limited, without raising the cost and increasing the size.

The feature of this invention is to suppress an oscillation of the base current of the power transistor through negative feedback control.

DESCRIPTION OF THE PREFERRED EMBODIMENTS

Figure 1:
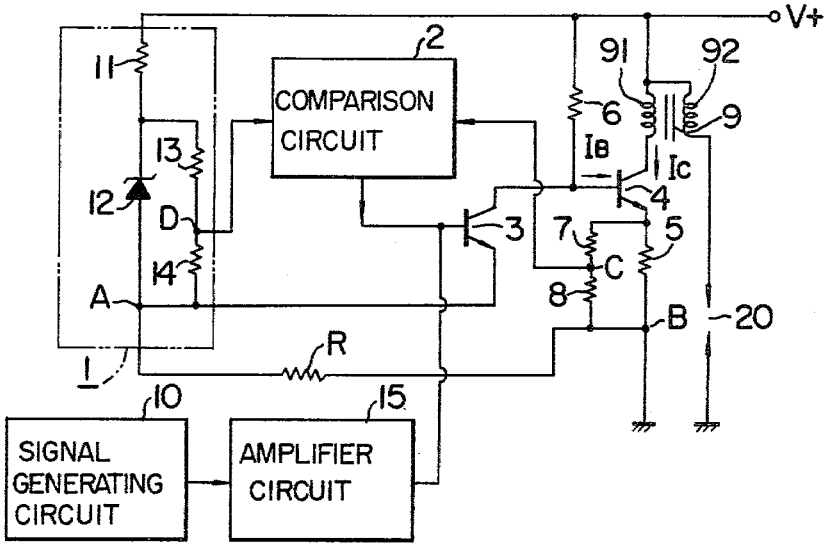
FIG. 1 schematically shows a circuit of an ignition apparatus according to an embodiment of the invention.

FIG. 1 shows an ignition apparatus according to an embodiment of this invention. The ignition apparatus comprises a reference voltage generating circuit 1 for generating a predetermined reference voltage, a comparison circuit 2, an ignition coil 9 having a primary winding 91 and a secondary winding 92 connected with a spark gap 20, a power transistor 4 for controlling a current through the primary winding 91 of the ignition coil 9, a drive transistor 3 for controlling the drive current for the power transistor 4, a current detecting resistor 5, resistors 7 and 8 for dividing the voltage developed across the resistor 5, a signal generating circuit 10 for generating a signal synchronous with the rotation of the engine, an amplifying circuit 15 for shaping and amplifying the output signal of the signal generating circuit 10 so as to supply an ignition timing signal to the base of the drive transistor 3, and a resistor R connected between ground (e.g. point B) and the junction point A of the negative terminal of the reference voltage generating circuit 1 and the emitter of the drive transistor 3. The reference voltage generating circuit 1 and the ignition coil 9 are connected with a power source V. The drive current for the power transistor 4 is supplied from the power source V through the resistor 6.

Figure 2:
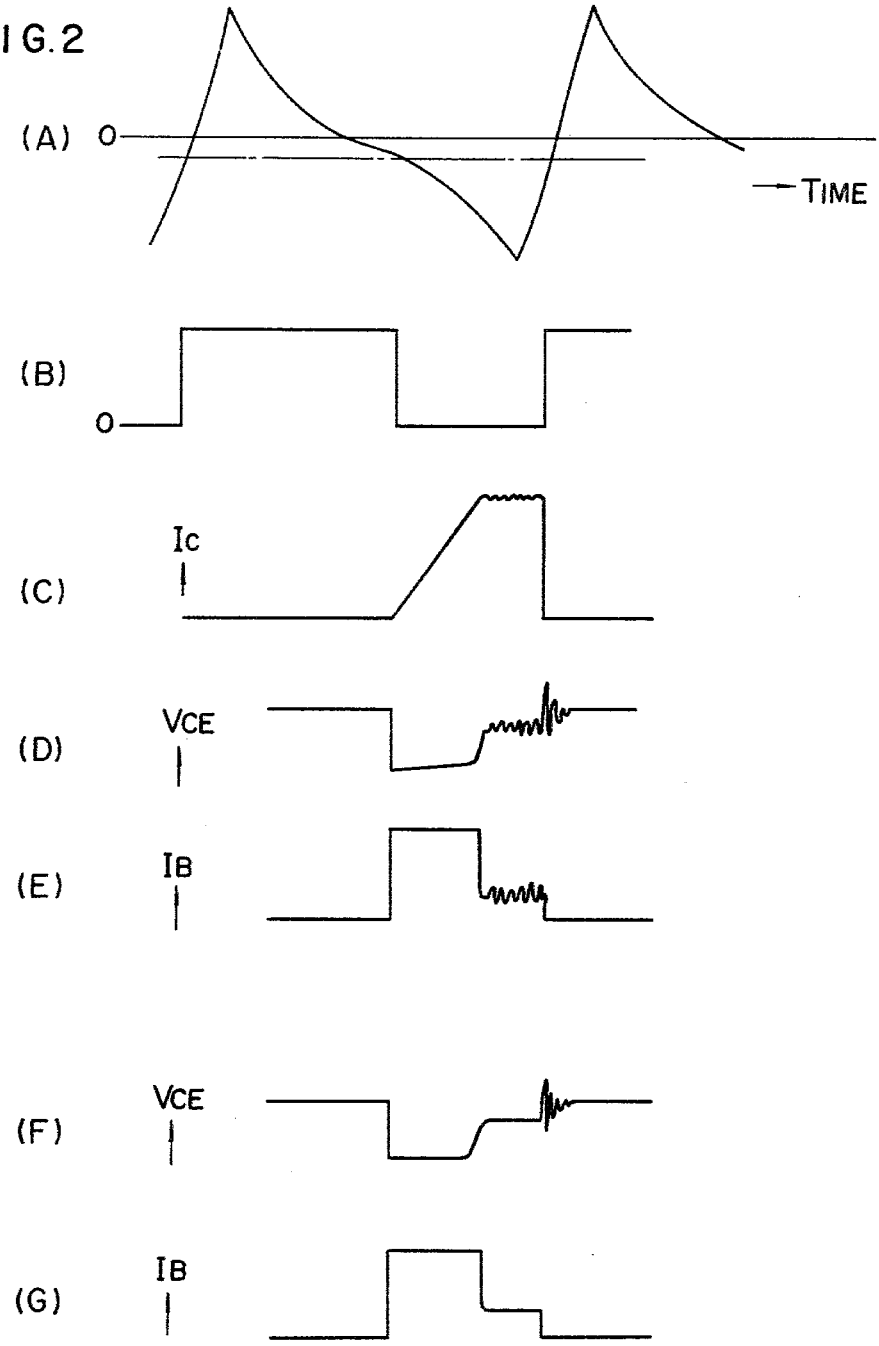
FIG. 2 shows waveforms useful in explaining the operation of the ignition apparatus shown in FIG. 1.

The signal generating circuit 10 generates a signal (e.g. a signal representing the angular position of the engine crank) synchronous with the engine, as shown in FIG. 2(A). This signal, after having been shaped and amplified by the amplifying circuit 15, is supplied to the drive transistor 3 as an ignition timing signal as shown in FIG. 2(B). When the ignition timing signal is not supplied to the drive transistor 3, it is in the off state. When the drive transistor 3 is in the off state, the potential at the collector of the transistor 3 is high. So, the power transistor 4 is supplied with a base bias through the resistor 6 so that the transistor 4 is turned on. Upon the conduction of the power transistor 4, a currrent flows through the primary winding 91 of the ignition coil 9 connected as a load of the transistor 4. The primary current of the ignition coil 9, i.e. the collector current $I_c$ of the power transistor 4, takes the waveform shown in FIG. 2(C) due to the inductance and the D.C. resistance of the primary winding 91 of the ignition coil 9. When the ignition timing signal is applied to the drive transistor 3, the transistor 3 is turned on. Accordingly, the potential at the collector of the transistor 3 falls so that the biasing voltage at the base of the power transistor 4 vanishes, whereby the power transistor 4 is turned off to interrupt the primary current of the ignition coil 9. At this moment, a high voltage is induced in the secondary winding 92 of the ignition coil 9, which produces electric spark across the spark gap 20 provided in the combustion chamber of the internal combustion engine.

The current control circuit for limiting the current flowing through the power transistor 4 is constituted by the current detecting resistor 5, the resistors 7 and 8, the reference voltage generating circuit 1, the comparison circuit 2 and the drive transistor 3. The collector current $I_c$ of the power transistor 4 develops a voltage drop across the current detecting resistor 5 connected between the emitter and ground. The current detecting resistor 5 is shunted by a series circuit of the resistors 7 and 8 and a voltage corresponding to the collector current is derived from the junction point C of the resistors 7 and 8 and applied to the comparison circuit 2.

The reference voltage for defining the upper limit of the collector current through the power transistor 4 is set by the reference voltage generating circuit 1 and applied to the comparison circuit 2. The comparison circuit 2 compares the voltage detected at the point C with the reference voltage and produces an output signal having an amplitude according to the difference between the detected voltage and the reference voltage. Namely, if the detected voltage is sufficiently lower than the reference voltage, the comparison circuit 2 delivers no output signal, while if the detected voltage is high enough to approximate the reference voltage, the comparison circuit delivers an output, the amplitude of which increases as the difference between the detected voltage and the reference voltage decreases. The output signal is supplied to the base of the drive transistor 3 so as to control the conduction of the transistor 3. As the collector current $I_c$ of the power transistor 4 increases, the detected voltage at the point C increases. At this time, the drive transistor 3 is in the off state. As the detected voltage rises, the comparison circuit 2 delivers an output signal to turn on the drive transistor 3. Consequently, the drive current (or base current) $I_B$ for the power transistor 4 decreases abruptly so that the collector voltage of the power transistor 4 rises to limit the primary current, i.e. the collector current $I_c$ to a predetermined level. The reference voltage is obtained from the junction point D of voltage dividing resistors 13 and 14 connected in series to shunt a zener diode 12 to which the voltage V of the power source is applied through a protective resistor 11.

In the case where a portion of the current control circuit, including the comparison circuit 2 and the drive transistor 3, and the amplifying circuit 15 are constructed with a monolithic IC, it is difficult to construct transistors constituting the comparison circuit 2 and the drive transistor 3 with respective desired values of the current amplification factor. Accordingly, it sometimes happens that the gain of the current control circuit becomes too large. Also, during the current limiting operation, the power transistor 4 is in the active state and therefore has a large current amplification factor. Moreover, the current amplification factor differs to a great extent among power transistors and a power transistor having a large current amplification factor must sometimes be used. If the gain of the current control circuit is too large and also if the current amplification factor of the power transistor is large, then a small oscillation is generated, during the current limiting operation, in the current control circuit due to the degraded response in the turn-on and turn-off operation of the power transistor or other causes. As a result, the collector-emitter voltage $V_{CE}$ of the power transistor oscillates as shown in FIG. 2(D) so that the collector current also oscillates. At this time, the drive current $I_B$ also oscillates as shown in FIG. 2(E). The period of the oscillation substantially depends on the response delay time of the power transistor. It has been ascertained that the oscillation is liable to diverge if the time during which the current limiting action is continued is long.

In the embodiment of the invention shown in FIG. 1, for preventing the oscillation, a resistor R having a small resistance of 0.5–1.5 Ω is connected between ground and the junction point A of the emitter of the drive transistor 3 and the negative terminal of the reference voltage generating circuit 1. In practice, the resistor R is preferably connected between the junction point A and the grounding point B of the resistor 5. By the provision of the resistor R, the reference voltage is increased by an amount equal to the voltage drop (several tens mV) across the resistor R caused due to the current flowing through the drive transistor 3 during the current limiting operation, and the operation of the current control circuit becomes stable at this increased level. When an oscillation takes place under this condition, the drive current $I_B$ for the power transistor oscillates, but since the increase in the base current $I_B$ causes the decrease in the current flowing through the collector-emitter path of the drive transistor, the potential at the point A is lowered with respect to the earth, so that the reference voltage is lowered. This causes an increase in the output signal of the comparison circuit and therefore intensifies the conduction of the drive transistor 3. As a result, the current flowing through the collector-emitter path of the drive transistor 3 is increased so that the base current $I_B$ is prevented from increasing. On the other hand, when the base current $I_B$ decreases, the reference voltage increases to decrease the output of the comparison circuit 2. Consequently, the conductivity of the drive transistor 3 decreases to prevent the decrease in the base current $I_B$. Namely, the resistor R serves to form a negative feedback circuit for the collector-emitter path of the drive transistor 3. This feedback circuit consists of a circuit loop including the reference voltage circuit 1 and the comparison circuit 2. Thus, by preventing the oscillation of the base current $I_B$ of the power transistor 4, the oscillation in the current control circuit is prevented so that the collector-emitter voltage and the base current of the power transistor 4 can be stabilized as shown in the waveform diagrams in FIGS. 2(F) and 2(G).

Figure 3:
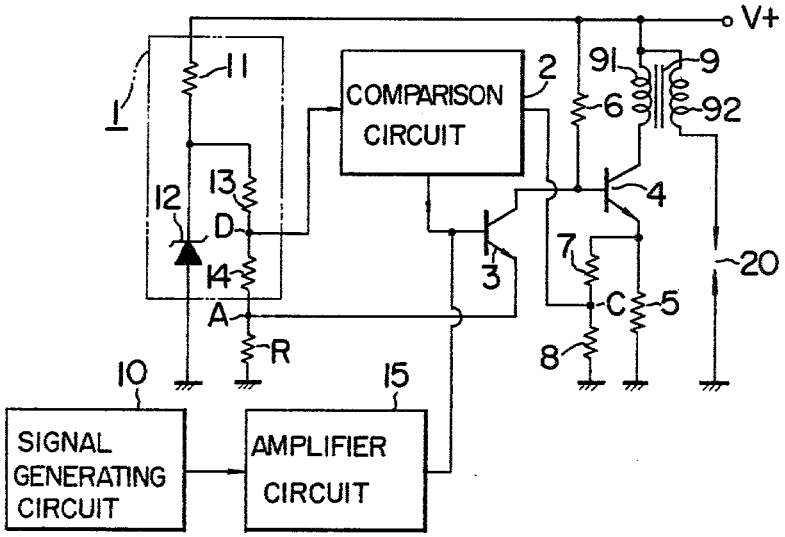
FIG. 3 schematically shows a circuit of an ignition apparatus according to another embodiment of this invention.

FIG. 3 shows a circuit of an ignition apparatus according to another embodiment of this invention. The same reference numerals and symbols are applied to equivalent circuit elements or parts as in FIG. 1. In this embodiment, the resistor R is connected between ground and the junction point of the resistor 14 and the emitter of the drive transistor 3, and the anode of the zener diode 12 is directly grounded. The zener diode 12 is usually contained in the monolithic IC, but it sometimes presents a difficulty. This embodiment is preferably employed in this case. The functions of ignition, current limitation and oscillation prevention in this embodiment are quite the same as in the embodiment shown in FIG. 1.

The resistance of the resistor R is very small, so that if the resistors in the current control circuit are formed through the thick film IC technique, the resistor R of about 0.5 to 1.5 Ω can be easily obtained by simply controlling the width and length of a conductor pattern. This avoids the necessity of providing a resistor as a discrete element and therefore reduces the cost of the ignition apparatus.

Figure 4:
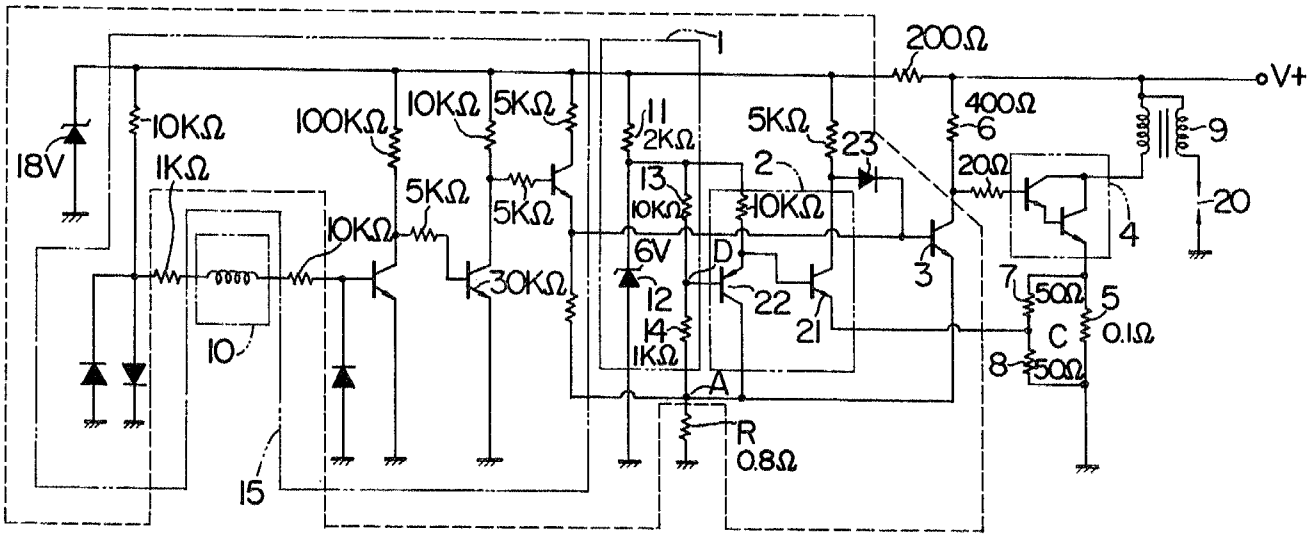
FIG. 4 shows a concrete circuit of the ignition apparatus according to the invention.

FIG. 4 shows a concrete example of the circuit of the embodiment shown in FIG. 3. The circuit 10 for generating a signal synchronous with the rotation of the engine is in practice, for example, a pickup coil incorporated in the distributor. The comparison circuit 2 is constituted by a transistor 21 and a temperature-compensation transistor 22, and the base and the emitter of the transistor 21 respectively receive the reference voltage and the detected voltage. When the drive current for the power transistor 4 and hence the current flowing through the collector-emitter path of the drive transistor 3 oscillate due to the oscillation taking place in the current control circuit, the level of the reference voltage derived from the junction point D of the resistors 13 and 14 changes due to the change in the voltage drop across the resistor R so that the base current of the transistor 21 is changed. As a result, the conductivity of the transistor 21 changes and therefore the amplitude of the signal supplied through a diode 23 to the base of the transistor 3 is changed. The change in the signal amplitude occurs so that the oscillation may be suppressed, as described above. In FIG. 4, the resistance values of the resistors are given only for showing a concrete example of the ignition apparatus according to this invention. In FIG. 4, the part of the circuit enclosed in the dashed line is constructed with a monolithic IC.

I claim:

1. An ignition apparatus for an internal combustion engine, comprising an ignition coil having a primary winding and a secondary winding connected at one end with a spark gap;

a power transistor connected in series with said primary winding to control flow of the primary current of said ignition coil;

a drive transistor for controlling the drive current for said power transistor;

a device for detecting a voltage proportional to the collector current of said power transistor;

a circuit for generating a preset reference voltage; and a comparison circuit for comparing the voltage detected by said detecting device with said reference voltage and for producing an output signal to control the conductivity of said drive transistor, wherein the collector-emitter path of said drive transistor is provided with a feedback circuit means including said reference voltage generating circuit and said comparison circuit for changing the reference voltage in accordance with the output signal of said comparison circuit.

2. An ignition apparatus as claimed in claim 1, wherein said feedback circuit is attained by a resistor connected between ground and the junction point of the emitter of said drive transistor and the negative terminal of said reference voltage generating circuit.

3. An ignition apparatus as claimed in claim 2, wherein said resistor has a resistance of 0.5 to 1.5 Ω.

4. An ignition apparatus for an internal combustion engine, comprising an ignition coil for producing a high voltage in an ignition plug;

means for generating an electrical signal representative of ignition timing:

a power transistor connected with the ignition coil for controlling a current supplied to the ignition coil in accordance with said ignition timing representing signal to produce the high voltage;

means for generating a first voltage in accordance with the current supplied to the ignition coil;

means for generating a second voltage as a reference voltage; and comparing means for comparing the first voltage and the second voltage an output signal in accordance with the difference between the first voltage and the second voltage for controlling the power transistor to limit the current supplied to the ignition coil in accordance with said difference;

wherein said apparatus further comprises means for changing the second voltage in accordance with the output of said comparing means .

5. An ignition apparatus as claimed in claim 4, wherein said second voltage changing means comprises first means for producing a signal in accordance with the output signal of the comparing means and second means for reducing said difference between the first voltage and the second voltage in accordance with the signal produced by said first means.

6. An ignition apparatus for an internal combustion engine, comprising an ignition coil for producing a high voltage in an ignition plug;

means for generating an electrical signal representative of ignition timing;

a power transistor connected with the ignition coil for controlling a current supplied to the ignition coil in accordance with said ignition timing representing signal to produce the high voltage;

means for generating a first voltage in accordance with the current supplied to the ignition coil;

means for generating a second voltage;

comparing means for comparing the first voltage and a reference voltage composed of at least said second voltage to produce an output signal in accordance with the difference between the first voltage and the reference voltage; and means for controlling the power transistor to limit the current supplied to the ignition coil in accordance with the output signal of the comparing means;

wherein said apparatus further comprises means for increasing the reference voltage in accordance with the output signal of the comparing means.

7. An ignition apparatus as claimed in claim 6, wherein said reference voltage increasing means comprises means for generating a third voltage in accordance with the output signal of the comparing means and means for adding the third voltage to the second voltage to provide the reference voltage composed of the sum of the second voltage and the third voltage.

* * * * *